US008638289B2

(12) United States Patent
Iisaka et al.

(10) Patent No.: US 8,638,289 B2
(45) Date of Patent: Jan. 28, 2014

(54) DRIVING METHOD AND COLOR SEQUENTIAL ELECTRO-OPTICAL APPARATUS WITH VARIED WAIT PERIODS BETWEEN SCANNING ANS IRRADIATION

(75) Inventors: Hidehito Iisaka, Suwa (JP); Hiroyuki Hosaka, Suwa (JP); Taku Kitagawa, Suwa (JP); Shuichi Nakanishi, Tokyo (JP); Atsushi Kato, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 401 days.

(21) Appl. No.: 12/606,790

(22) Filed: Oct. 27, 2009

(65) Prior Publication Data

US 2010/0103205 A1 Apr. 29, 2010

(30) Foreign Application Priority Data

Oct. 28, 2008 (JP) ..... 2008-277066

(51) Int. Cl.
*G09G 3/36* (2006.01)

(52) U.S. Cl.
USPC ..... 345/102

(58) Field of Classification Search
USPC ..... 345/87, 102
See application file for complete search history.

(56) References Cited

U.S. PATENT DOCUMENTS

| | | | | |
|---|---|---|---|---|
| 6,421,037 | B1 * | 7/2002 | Chen | 345/92 |
| 7,030,848 | B2 * | 4/2006 | Sato et al. | 345/99 |
| 7,106,276 | B2 * | 9/2006 | Akiyama | 345/204 |
| 2002/0149576 | A1 * | 10/2002 | Tanaka et al. | 345/204 |
| 2004/0041760 | A1 | 3/2004 | Tsumura et al. | |
| 2005/0179637 | A1 * | 8/2005 | Iisaka | 345/102 |
| 2007/0152945 | A1 * | 7/2007 | Park et al. | 345/98 |
| 2007/0229444 | A1 * | 10/2007 | Liu et al. | 345/102 |
| 2009/0102867 | A1 * | 4/2009 | Lai et al. | 345/691 |

FOREIGN PATENT DOCUMENTS

| | | |
|---|---|---|
| JP | 11-237606 | 8/1999 |
| JP | 2003-107425 | 4/2003 |
| JP | 2004-093717 A | 3/2004 |

* cited by examiner

*Primary Examiner* — Adam J Snyder
(74) *Attorney, Agent, or Firm* — Maschoff Brennan

(57) ABSTRACT

A driving method includes: dividing a unit period into a plurality of sub-frame periods corresponding to the primary colors; writing a primary color component in each sub-frame period by a first scan executed on the plurality of pixels; irradiating, in each sub-frame period, the plurality of pixels with the corresponding primary color of light by the irradiation unit at a timing that is after the first scan and before the first scan of a subsequent sub-frame period; and waiting a wait period that is from when the first scan of one primary color component among the at least three colors ends until when the irradiation unit starts irradiating the one primary color of light, the wait period for the one primary color being different from wait periods for the other colors.

11 Claims, 12 Drawing Sheets

10
Vid
30
IMAGE PROCESSING CIRCUIT
Vd
40
DATA SIGNAL CONVERSION CIRCUIT
Vs
100
140
X DRIVER
d1
d2
d3
d4
d1023
d1024
100a
112
110
114
G1
G2
G3
G4
G767
G768
130
Y DRIVER
20
CONTROL CIRCUIT
Sync
11R
11G
11B

| | BRIGHTNESS | COLOR REPRODUCIBILITY | RESOLUTION | |
|---|---|---|---|---|
| FIRST EMBODIMENT | × | △ | ○ | EMPHASIS ON RESOLUTION |
| SECOND EMBODIMENT | △ | ○ | △ | EMPHASIS ON COLOR REPRODUCIBILITY |
| THIRD EMBODIMENT | △ | △ | △~○ | EMPHASIS ON BALANCE |
| FOURTH EMBODIMENT | ○ | △ | ○ | EMPHASIS ON BRIGHTNESS |

DRIVING METHOD AND COLOR SEQUENTIAL ELECTRO-OPTICAL APPARATUS WITH VARIED WAIT PERIODS BETWEEN SCANNING ANS IRRADIATION

CROSS REFERENCE TO RELATED APPLICATIONS

The entire disclosures of Japanese Patent Application No. 2008-277066 filed on Oct. 28, 2008 is expressly incorporated by reference herein.

BACKGROUND

1. Technical Field

The present invention relates to technology for driving a so-called color sequential electro-optical apparatus.

2. Related Art

Generally, in the color sequential method, a frame period in which a single color image is formed is divided into sub-frame periods corresponding to, for example, the three primary colors red (R), green (G), and blue (B). In each sub-frame period, information (e.g., a voltage) that is in accordance with the tone (brightness) of the primary color component corresponding to the sub-frame period is written to the pixels of a display panel, and thereafter, the display panel is irradiated with the corresponding primary color of light. Accordingly, R, G, and B primary color images are displayed sequentially. To a person, these primary color images become superimposed and are viewed as a full-color image (see JP-A-11-237606). In such a color sequential method, there is no need to provide the display element with a color filter, and furthermore, there is no need to divide a pixel into R, Q and B sub-pixels, thus facilitating an increase in definition.

In such a color sequential method, when employing a configuration in which, in each sub-frame, information (e.g., a voltage) that is in accordance with the brightness of the corresponding primary color component is written to all of the pixels, and thereafter, the irradiation of the pixels with the corresponding primary color of light is started, there is the possibility of not being able to obtain a sufficient screen brightness. Accordingly, a method has been proposed in which the irradiation of light is started before writing to all of the pixels has ended (see JP-A-2003-107425).

SUMMARY

This method is effective in terms of ensuring the screen brightness. However, depending on the display element, there are cases in which the optical response characteristic varies according to the wavelength.

In such cases, irradiated light passes through or is reflected by pixels before an optical characteristic that is in accordance with written information has been achieved in the pixels, and therefore the pixels are viewed in a state in which the written information is not reflected sufficiently.

The invention has been achieved in light of the situation described above, and an aim thereof is to provide technology that, in the color sequential method, ensures a sufficient screen brightness, and additionally takes into consideration cases in which the optical response characteristic varies according to the wavelength.

According to one aspect of the invention, there is provided a driving method for an electro-optical apparatus that includes a plurality of pixels and an irradiation unit, each of the pixels having a transmissivity or a reflectivity in response to writing, the irradiation unit sequentially irradiating the plurality of pixels with at least three different primary colors of light. The method includes: dividing a unit period into a plurality of sub-frame periods corresponding to the primary colors; writing a primary color component in each sub-frame period by a first scan executed on the plurality of pixels; irradiating, in each sub-frame period, the plurality of pixels with the corresponding primary color of light by the irradiation unit at a timing that is after the first scan and before the first scan of a subsequent sub-frame period; and waiting for duration of a wait period that is from when the first scan of one primary color component among the at least three colors ends until when the irradiation unit starts irradiating the one primary color of light, the wait period for the one primary color being different from wait periods for the other colors.

It is preferable that the wait period of each primary color is made longer as the wavelength of the primary color is shorter, or shorter as the wavelength of the primary color is shorter. This is because as the wavelength becomes shorter, there are cases in which the optical response characteristic degrades and cases in which the optical response characteristic improves.

It is preferable that, in the first scan, writing is executed on the plurality of pixels such that an image whose resolution is lower than a resolution specified for the plurality of pixels is formed, and execution or non-execution of a second scan is defined for each primary color, the second scan being a scan in which writing is executed on the plurality of pixels such that an image whose resolution is higher than the low resolution is formed, subsequent to the first scan. If the primary color for which the second scan is not executed is fixed, there are cases in which this primary color stands out, and therefore, a primary color for which non-execution of the second scan is defined may be changed for each unit period.

It is preferable that a primary color for which non-execution of the second scan is defined is, among the primary colors, a color whose optical response to writing is fastest.

It is preferable that a primary color for which non-execution of the second scan is defined is changed for each unit period.

It is preferable that the resolution of an image formed by the first scan of one primary color component among the at least three colors is caused to be different from the resolution of images formed by the first scan of the other color components.

It is preferable that the primary color for which the resolution of the image formed by the first scan is highest is, among the at least three primary colors, a color excluding a primary color whose wavelength is shortest and a primary color whose wavelength is longest.

It is preferable that the primary color for which the resolution of the image formed by the first scan is lowest is, among the at least three primary colors, a color whose optical response to writing is fastest.

It is preferable that the irradiation unit is capable of irradiating white light in addition to the at least three different primary colors of light, the unit period is divided into a plurality of sub-frame periods corresponding to the primary colors and white, the irradiation unit irradiates the plurality of pixels with the white light at a timing that is after the first scan of the white component and before the first scan of a subsequent sub-frame period, and the resolution of an image formed by the first scan of the white component is caused to be higher than the resolution of images formed by the first scan of the primary color components.

According to yet another aspect of the invention, there is provided a driving method for an electro-optical apparatus that includes a plurality of pixels each having a transmissivity or a reflectivity that is in response to writing, and an irradiation unit that sequentially irradiates the plurality of pixels with at least three different primary colors of light. The method including: dividing a unit period into a plurality of sub-frame periods corresponding to the primary colors; writing a primary color component in each sub-frame period by a first scan executed on the plurality of pixels; irradiating, in each sub-frame period, the plurality of pixels with the corresponding primary color of light by the irradiation unit at a timing that is after the first scan and before the first scan of a subsequent sub-frame period; waiting for duration of a wait period that is from when the first scan of one primary color component among the at least three colors ends until when the irradiation unit starts irradiating the one primary color of light, the wait period for the one primary color being different from wait periods for the other colors; and selecting one process from among the following process A to D: (A) a process in which the wait period of each primary color is made longer as the wavelength of the primary color is shorter, or shorter as the wavelength of the primary color is shorter; (B) a process in which in the first scan, writing is executed on the plurality of pixels such that an image whose resolution is lower than a resolution specified for the plurality of pixels is formed, execution or non-execution of a second scan is defined for each primary color, the second scan being a scan in which writing is executed on the plurality of pixels such that an image whose resolution is higher than the low resolution is formed, subsequent to the first scan, and a primary color for which non-execution of the second scan is defined is, among the primary colors, a color whose optical response to writing is fastest; (C) a process in which the resolution of an image formed by the first scan of one primary color component among the at least three colors is caused to be different from the resolution of images formed by the first scan of the other color components, and a primary color for which the resolution of the image formed by the first scan is highest is, among the at least three primary colors, a color excluding a primary color whose wavelength is shortest and a primary color whose wavelength is longest; and (D) a process in which the irradiation unit is capable of irradiating white light in addition to the at least three different primary colors of light, the unit period is divided into a plurality of sub-frame periods corresponding to the primary colors and white, the irradiation unit irradiates the plurality of pixels with the white light at a timing that is after the first scan of the white component and before the first scan of a subsequent sub-frame period, and the resolution of an image formed by the first scan of the white component is caused to be higher than the resolution of images formed by the first scan of the primary color components.

According to yet another aspect of the invention, there is provided an electro-optical apparatus including: a plurality of pixels each having a transmissivity or a reflectivity that is in accordance with writing; an irradiation unit that sequentially irradiates the plurality of pixels with at least three different primary colors of light; a driving circuit that divides a unit period into a plurality of sub-frame periods corresponding to the primary colors, and writes a primary color component in each sub-frame period by a first scan executed on the plurality of pixels; and a control circuit that controls the irradiation unit to, in each sub-frame period, irradiate the plurality of pixels with the corresponding primary color of light at a timing that is after the first scan and before the first scan of a subsequent sub-frame period, and performs control so that a wait period that is from when the first scan of one primary color component among the at least three colors ends until when the irradiation unit starts irradiating the one primary color of light is different from wait periods for the other colors.

BRIEF DESCRIPTION OF THE DRAWINGS

Exemplary embodiments of the invention will be described in detail based on the following figures, wherein.

DETAILED DESCRIPTION

1. First Exemplary Embodiment

Figure 1:
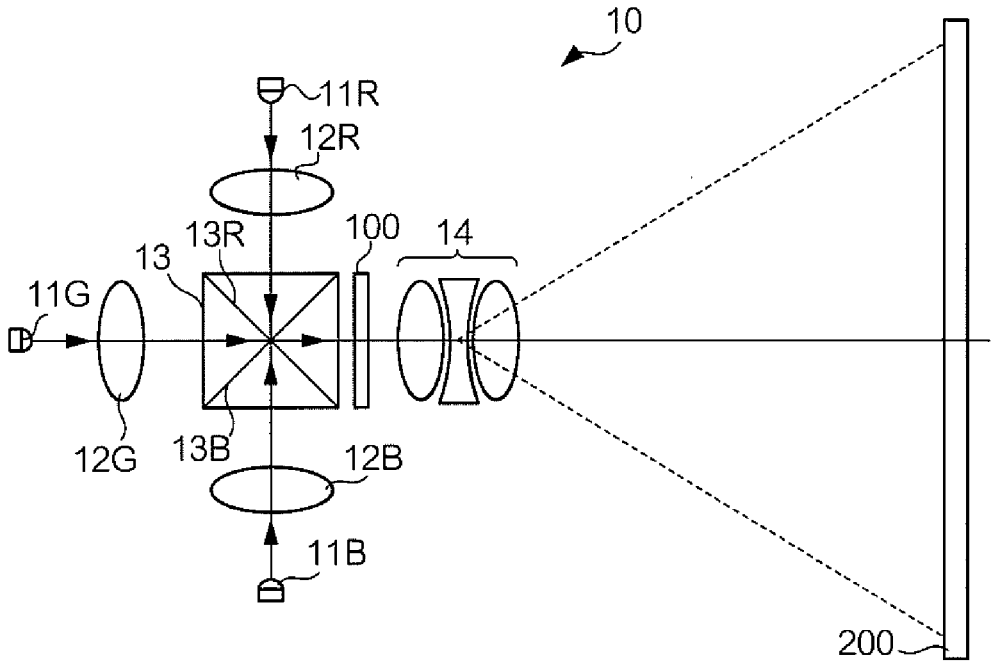
FIG. 1 shows a configuration of a projector to which a driving method according to a first exemplary embodiment is applied.

First, a description is given for a driving method for an electro-optical apparatus according to a first exemplary embodiment of the invention. FIG. 1 shows an optical configuration of a projector 10 that is an example of an electro-optical apparatus to which this driving method has been applied. In FIG. 1, an LED 11R is located in the direction of 12 o'clock as viewed from the center of a dichroic prism 13. The LED 11R is a light emitting diode that emits R (red) light downward in FIG. 1. The R light emitted by the LED 11R is focused into a substantially parallel light beam by a collimator lens 12R. Likewise, an LED 11G and an LED 11B are located in directions of 9 o'clock and 6 o'clock respectively. The LED 11G is a light emitting diode that emits G (green) light rightward in FIG. 1, and the LED 11B is a light emitting diode that emits B (blue) light upward in FIG. 1. The G and B light emitted by the LEDs 11G and 11B are also focused into substantially parallel light beams by collimator lenses 12G and 12B respectively. Note that the LEDs 11R, 11G, and 11B are controlled by a control circuit that is described later, so as to emit light in order. A set of these three LEDs is an example of an irradiation unit.

The dichroic prism 13 has dichroic faces 13R and 13B that are orthogonal to each other. Among these, the dichroic face 13R reflects R light that has incidented thereon from the 12 o'clock direction, and the R light exits in the 3 o'clock direction. The dichroic face 13R transmits the other colors of light. The dichroic face 13B reflects B light that has incidented thereon from the 6 o'clock direction, and the B light exits in the 3 o'clock direction. The dichroic face 13B transmits the other colors of light. The dichroic faces 13R and 13B both transmit G light that has incidented thereon from the 9 o'clock direction, and the G light exits in the 3 o'clock direction.

A display panel 100 is disposed at the exit face of the dichroic prism 13. In the present exemplary embodiment, the display panel 100 is, for example, an active-matrix transmissive liquid crystal display panel and includes multiple pixels. A projection lens group 14 is an optical system that enlarges and projects a transmission image onto a screen 200. The transmission image is formed as a result of the display panel 100 controlling the transmissivity of each pixel. As described later, in the operation of the projector 10, a frame period is divided into R, G, and B sub-frame periods. In each sub-frame period, a voltage is written to each pixel so that a primary color component brightness is achieved. Thereafter, an operation for causing a primary color LED to emit light is repeated for R, G and B. As a result, R, G, and B primary color images are displayed sequentially, and these primary color images become overlapped and are viewed as a full-color image.

Figure 2:
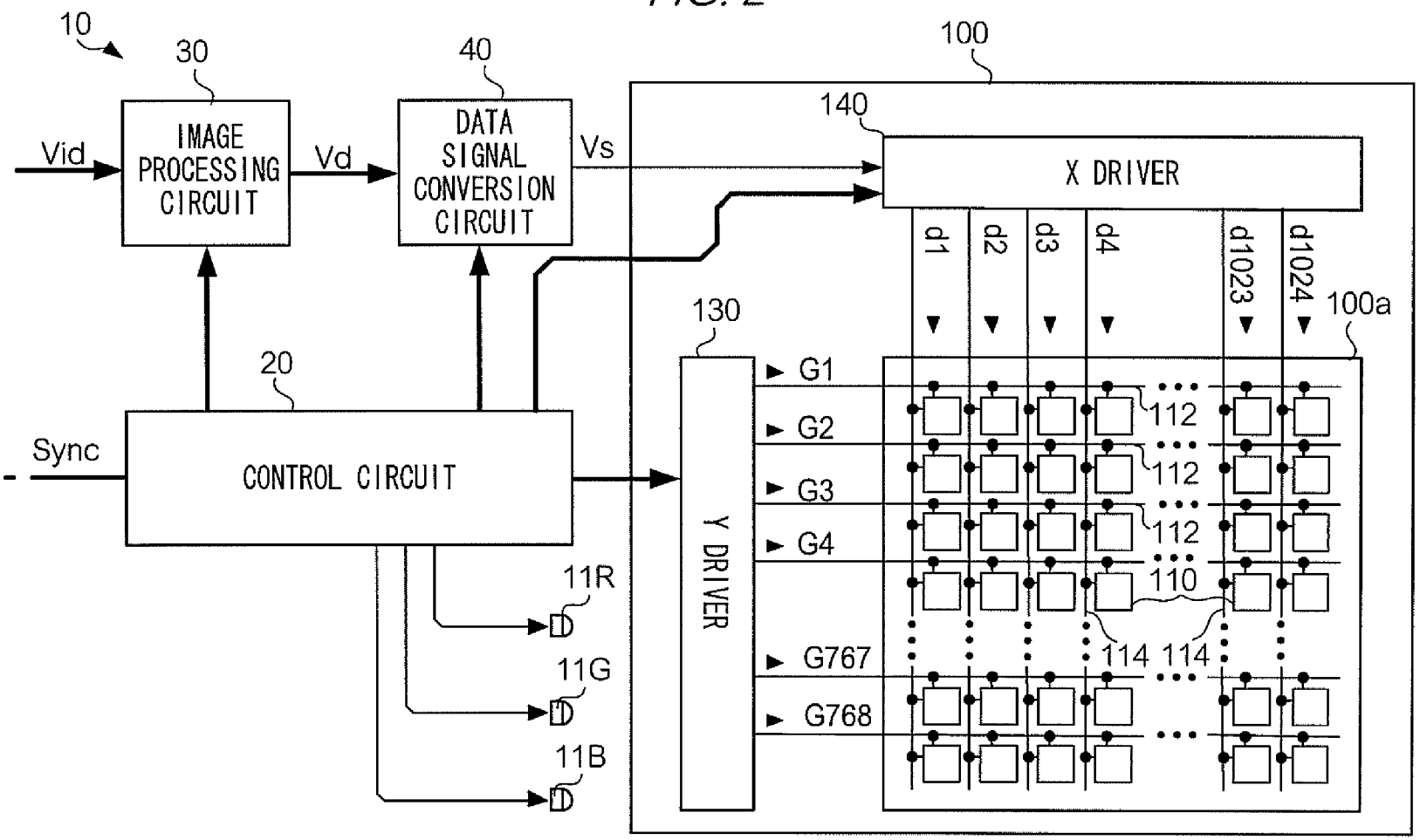
FIG. 2 shows a block diagram illustrating an electrical configuration of the projector.

FIG. 2 shows an electrical configuration of the projector 10. As shown in FIG. 2, the projector 10 includes a control circuit 20, an image processing circuit 30, a data signal conversion circuit 40, and the display panel 100. Among these, the control circuit 20 controls the other units based on a synchronization signal Sync that is supplied from a higher-level apparatus (not shown in FIG. 2). The image processing circuit 30 temporarily stores, in an internal memory, a digital video signal Vid that is supplied from a higher-level apparatus. Thereafter, under control of the control circuit 20, the image processing circuit 30 reads each color component, and outputs the read color components as video signals Vd. Here, the video signal Vid supplied from the higher-level apparatus is digital data that designates the brightness (tone) of the R, G and B color components for each pixel of the display panel 100. The video signal Vid is supplied to each pixel in a scan order that is in accordance with a vertical scan signal, a horizontal scan signal, and a dot clock signal (not shown in FIG. 2) that are included in the synchronization signal Sync.

The data signal conversion circuit 40 converts the video signals Vd supplied from the image processing circuit 30 into analog data signals Vs that are suited for the driving of the display panel 100. The data signal conversion circuit 40 supplies the data signals Vs to the display panel 100 in conformity with the timing of driving by a Y driver 130 and an X driver 140.

In a display area 100*a* of the display panel 100, for example, 768 rows of scan lines 112 extend in the horizontal direction in FIG. 2, and 1024 columns of data lines 114 extend in the vertical direction in FIG. 2. The data lines 114 are provided such that electrical insulation is maintained with respect to the scan lines 112. Pixels 110 are arranged in correspondence with intersections between the scan lines 112 and the data lines 114. In this example, the pixels 110 are aligned in the display area 100*a* in a matrix configuration that includes 768 rows vertically and 1024 columns horizontally. Note that in order to distinguish between the scan lines 112, in the following description, they are sometimes called the 1st, 2nd, 3rd, . . . , and 768th scan lines 112 in order from the top in FIG. 2. Likewise, in order to distinguish between the data lines 114, they are sometimes called the 1st, 2nd, 3rd, . . . , and 1024th data lines 114 in order from the left in FIG. 2.

The Y driver 130 is a scan line driving circuit that, under control of the control circuit 20, supplies scan signals to the scan lines. The Y driver 130 applies a selection voltage to selected scan lines, and applies a non-selection voltage to the other scan lines. Note that the scan signals that are supplied to the 1st, 2nd, 3rd, . . . , and 768th scan lines 112 are respectively indicated in FIG. 2 as G1, G2, G3, . . . , and G768. The X driver 140 is a data line driving circuit that, for each pixel 110 corresponding to a selected row, samples a data signal Vs that has been converted by the data signal conversion unit 40, and outputs the resulting data signals to the respective data lines 114. Note that the sampled data signals output to the 1st, 2nd, 3rd, . . . , and 1024th data lines 114 are respectively indicated in FIG. 2 as d1, d2, d3, . . . , and d1024.

Figure 3:
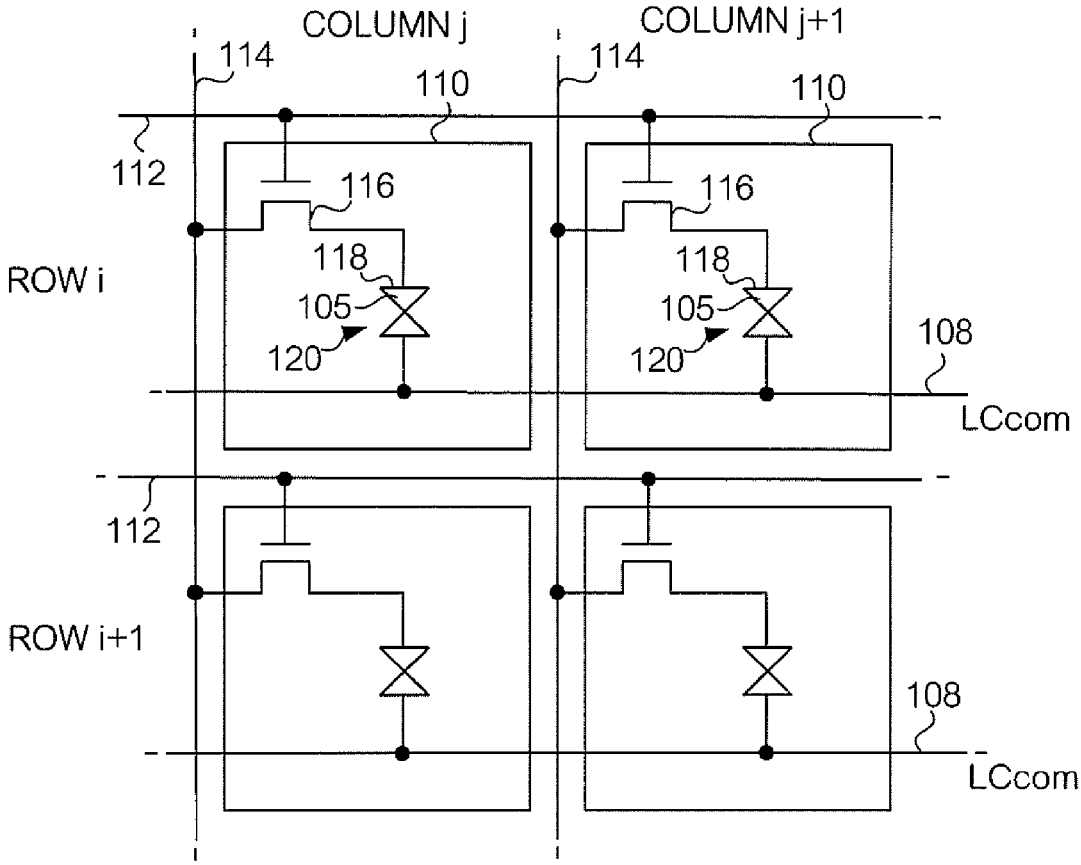
FIG. 3 shows a configuration of pixels in a display panel of the projector.

FIG. 3 shows a configuration of the pixels 110. As shown in FIG. 3, in each pixel 110, the source electrode of an n-channel TFT (Thin Film Transistor) 116 is connected to a data line 114. Furthermore, the drain electrode is connected a pixel electrode 118, and the gate electrode is connected to a scan line 112. Each pixel has a pixel electrode 118. A counter electrode 108 is provided commonly to all pixels, and thus all of the pixel electrodes 118 are opposed by a counter electrode 108. A constant voltage LCcom is applied to the counter electrodes 108. In each pixel, a liquid crystal 105 is sandwiched between the counter electrode 108 and the pixel electrode 118, thus configuring a liquid crystal element 120. As a result, each pixel includes a liquid crystal element 120 that includes a pixel electrode 118, a counter electrode 108, and a liquid crystal 105.

In each liquid crystal element 120 configured as described above, a voltage is held between the pixel electrode 118 and the counter electrode 108. In the case of being the transmissive type, each liquid crystal element 120 has a transmissivity that is in accordance with the effective value of the held voltage. This is because in each liquid crystal element 120, the molecular orientation state of the liquid crystal 105 interposed between the pixel electrode 118 and the counter electrode 108 changes according to the voltage between these electrodes. When a selection voltage is applied to a scan line 112, and a data signal whose voltage is in accordance with a designated tone value is supplied to the data line 114 of a pixel corresponding to the selected scan line 112, the TFT 116 of the pixel 110 in the selected scan line enters an ON state. The data signal is applied to the pixel electrode 118 via the TFT 116 that is in the ON state. In this way, in each liquid crystal element 120, a voltage that is in accordance with a tone value is applied and held, and a transmissivity that is in accordance with a desired tone is achieved in the liquid crystal element 120. Note that even when a non-selection voltage is applied to a scan line, thus causing the TFT 116 to enter an OFF state, the voltage that was written to the liquid crystal element 120 when the TFT 116 was in the ON state is held due to the capacitive ability of the liquid crystal element 120.

In this example, the display panel 100 operates in a normal white mode. In the normal white mode, if the effective value of the voltage held in the liquid crystal element 120 is close to zero, the optical transmissivity becomes maximal, and the color white is displayed. As the effective value of the voltage increases, the transmitted amount of light decreases. Also, while the data signal conversion circuit 40 converts the video signals Vd into data signals Vs, polarity switching is performed in order to prevent a direct current component from being applied to the liquid crystal 105. The video signals Vd are signals that designate the brightness of pixels. The data signals Vs are signals that are applied to the pixel electrodes 118. The polarity is alternately switched between a positive voltage whose potential is higher than a reference voltage Vc and a negative voltage whose potential is lower than the reference voltage Vc, each time a predetermined period has elapsed. The reference voltage Vc is substantially the same voltage as the voltage LCcom of the counter electrodes 108, or a voltage whose potential is lower than the voltage LCcom. The predetermined period is, for example, the later-described sub-frame period, or the frame period. The polarity is designated by the control circuit 20.

Figure 15:
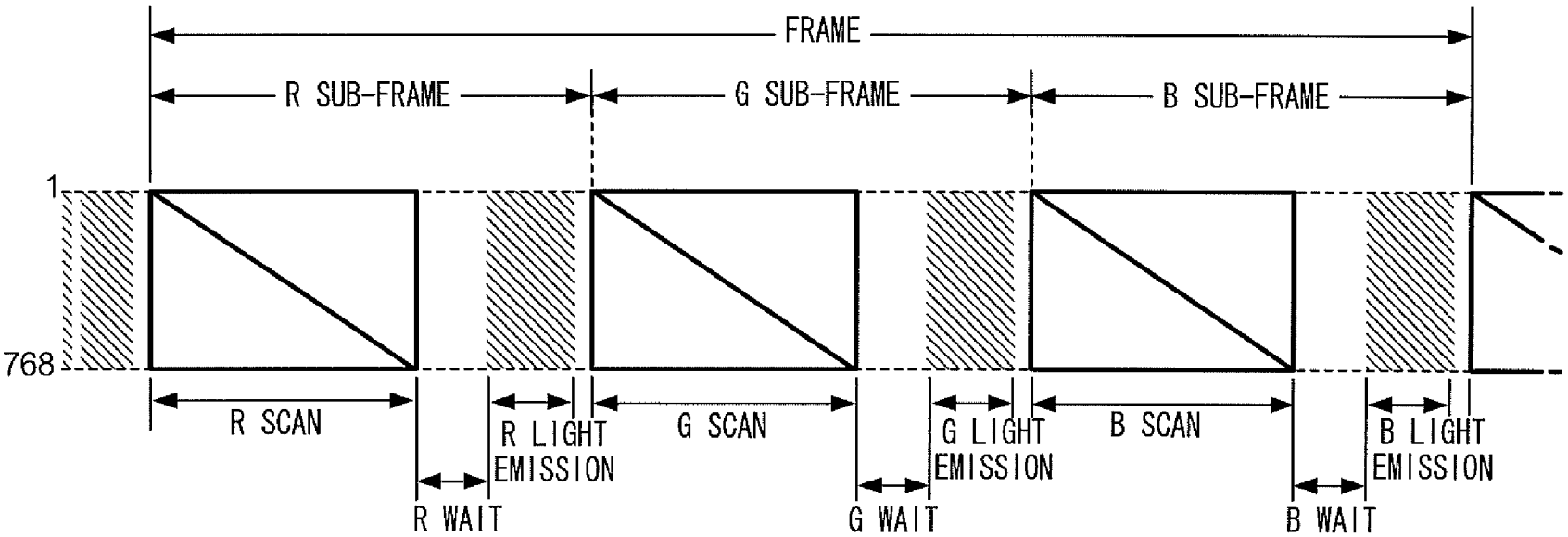
FIG. 15 shows a driving method according to a comparative example.

Before describing the driving method according to the present exemplary embodiment, the following describes a conventional driving method in the configuration of FIG. 2 for the sake of comparison. FIG. 15 shows conventional color sequential driving. In FIG. 15, the frame period is, in the driving of the display panel 100 and the LEDs 11R, 11G, and 11B, the period required for displaying one frame-worth of a color image. For example, if the vertical scan frequency is 60 Hz, the frame period is 16.7 msec, which is the reciprocal of the vertical scan frequency. Note that the frame period and the vertical scan period specified by the synchronization signal Sync are the same in terms of period-length. However, the video signal Vid that is supplied in synchronization with a synchronization signal Vsync is once stored in the image processing circuit 30, and thereafter read out. The display panel 100 is driven in conformity with this reading. Accordingly, in terms of timing, the frame period is delayed with respect to the vertical scan period.

Figures 6, 12:
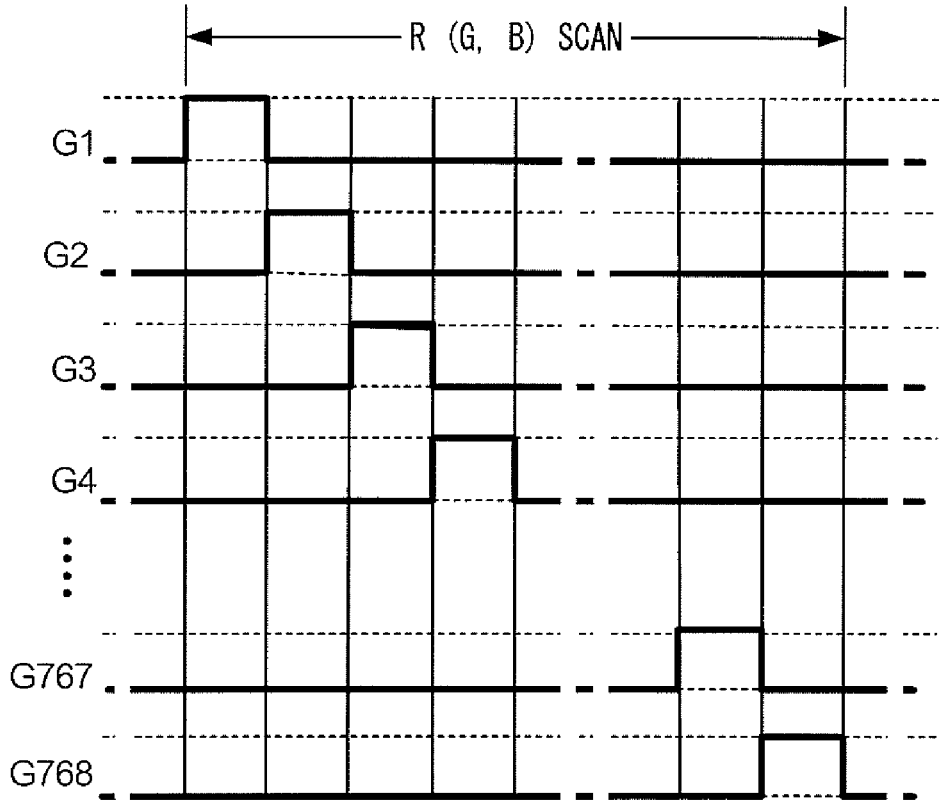
FIG. 6 shows a first scan in the driving method.
FIG. 12 shows a comparison of the exemplary embodiments.

As shown in FIG. 15, the frame period is equally divided into the three R, G and B sub-frame periods. The R sub-frame period includes an R scan period, an R wait period, and an R light emission period. In the R scan period, data signals that are in accordance with R component tones are written row-by-row to the pixels 110 of the display panel 100. Specifically, in the R scan period, the control circuit 20 controls the image processing circuit 30 to read the video signal stored in the internal memory at three times the writing speed (i.e., a speed that is three times the scan speed specified by the synchronization signal Vsync). Furthermore, the control circuit 20 designates the polarity for the data signal conversion circuit 40. The control circuit 20 controls the Y driver 130 to apply the selection voltage to the 1st, 2nd, 3rd, . . . , and 768th scan lines 112 in order, in accordance with the reading row. Accordingly, the Y driver 130 outputs the scan signals G1, G2, G3, . . . , and G768 as shown in FIG. 6. Also, the control circuit 20 controls the X driver 140 to sample the data signal Vs and, column-by-column, output the resulting signals to the 1st, 2nd, 3rd, . . . , and 1024th data lines 114 in order. According to this control, in each pixel 110, a transmissivity that is in accordance with the corresponding R component tone is achieved. Then, in order for this R component image to be viewed, the control circuit 20 waits for the duration of the R wait period once the R scan period of the R sub-frame period has ended, and thereafter causes only the LED 11R to emit light for the duration of the R light emission period.

Next, in the G sub-frame period, the control circuit 20 performs control so that in the G scan period, data signals that are in accordance with G component tones are written to the pixels 110 of the display panel 100. The control circuit 20 then waits for the duration of the G wait period once the G scan period has ended, and thereafter causes only the LED 11G to emit light for the duration of the G light emission period. Then, in the B sub-frame period, the control circuit 20 performs control so that in the B scan period, data signals that are in accordance with B component tones are written to the pixels 110 of the display panel 100. The control circuit 20 then waits for the duration of the B wait period once the B scan period has ended, and thereafter causes only the LED 11B to emit light for the duration of the B light emission period. When the R, G, and B primary color images are sequentially displayed, to a person, these primary color images become overlapped and are viewed as a full-color image. Note that in FIG. 15, the lines sloping downward and rightward in the R, G, and B scan periods indicate that the selected row among the scan lines is progressing downward from the top as time elapses. Although the scan line selection periods are actually short straight lines, they are sufficiently short in comparison to the time axis, and therefore are indicated as a continuous diagonal line.

Even when a voltage that is in accordance with a tone is written to a liquid crystal element 120, a transmissivity that is in accordance with the written voltage is not immediately achieved since the response speed of the liquid crystal element 120 is relatively slow. For this reason, as described above, a constant wait period is placed between when the R, G, and B scan periods end and when LED light emission starts, thus causing the LEDs to emit light while having achieved an optical response (transmissivity) that is in accordance with the written voltage. Also, the durations of the R light emission period, the G light emission period, and the B light emission period are set to the same duration in order to balance the intensities of the primary colors, that is to say, in order to prevent the white balance from becoming imbalanced.

Figure 4:
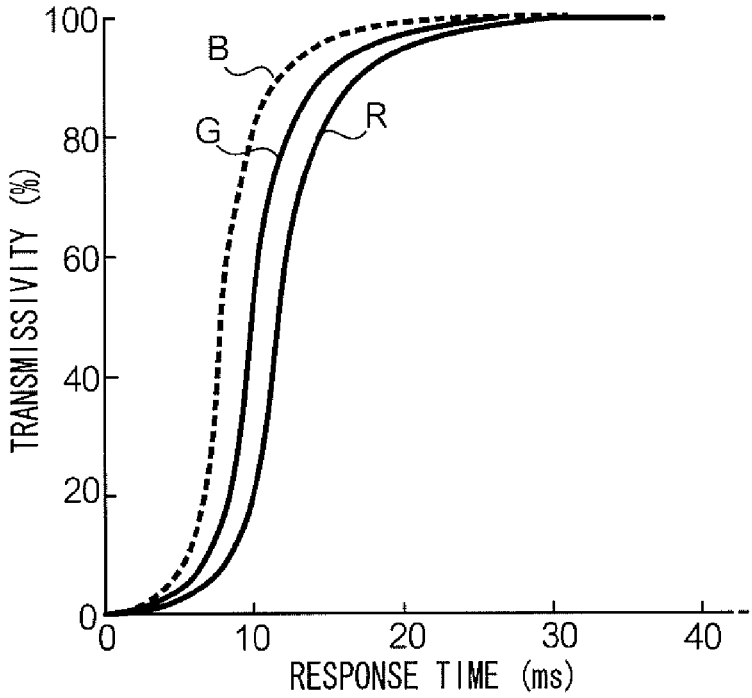
FIG. 4 shows optical response characteristics of liquid crystal elements in the pixels.

Incidentally, the inventor(s) of the invention found that the electro-optical response characteristics of the liquid crystal elements 120 differ depending on the wavelength of light that passes through the liquid crystal 105. FIG. 4 shows the optical response characteristics of the liquid crystal elements 120. As shown in FIG. 4, when pixels are changed from 0% relative transmissivity (or relative reflectivity), which is the darkest state, to 100% relative transmissivity, which is the brightest state, the actual transmissivity characteristic (optical response characteristic) with respect to elapsed time degrades as the wavelength becomes longer. Accordingly, in conventional color sequential driving, if the durations of the R, G, and B waiting periods are the same, R light and G light is irradiated on the display panel 100 before a transmissivity that is in accordance with a designated tone has been achieved, and this occurs particularly with the R component. As a result, it is possible for the image formed by the liquid crystal elements 120 to be viewed having a different brightness from the brightness designated by the video signal Vid. Note that FIG. 4 is merely an example. Depending on the operation mode of the liquid crystal, there are cases in which, conversely, the response characteristic improves as the wavelength becomes longer.

Figure 5:
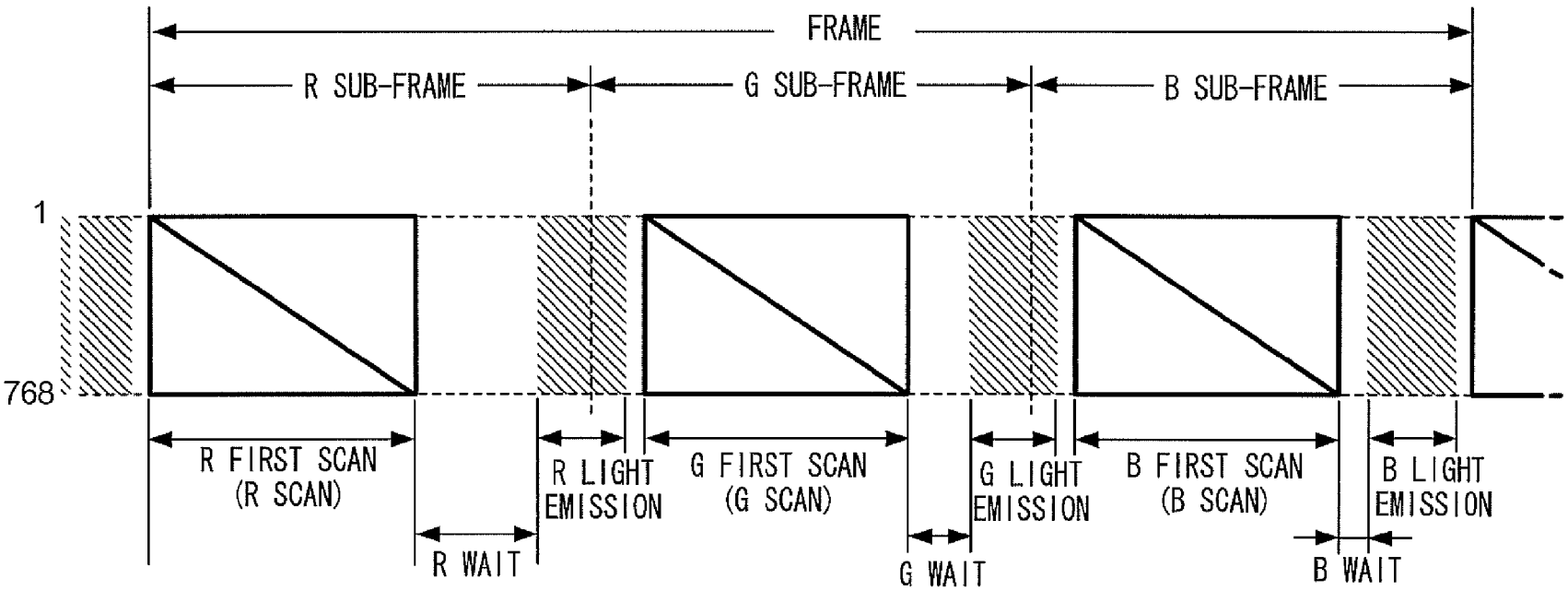
FIG. 5 shows the driving method.

In view of this, in the present exemplary embodiment, when the optical responsiveness degrades as the wavelength becomes longer as shown in FIG. 4, the wait periods are set so that a condition, (R wait period)>(G wait period)>(B wait period), is satisfied as shown in FIG. 5. Here, when the R wait period is made longer, the end of the R light emission period becomes overlapped with the subsequent G sub-frame period. In order to address this, the start of the G scan period is delayed. When the start of the G scan period is delayed, the end of the G light emission period becomes overlapped with the subsequent B sub-frame period. In order to address this, the start of the B scan period is delayed. However, B light has a short wavelength and the optical response is good, and therefore there is no problem if the B wait period is short. For this reason, the end of the B light emission period does not become overlapped with the R sub-frame period of the subsequent frame. The control circuit 20 controls the driving of the display panel 100 as well as controls light emission performed by the LEDs 11R, 11G, and 11B in accordance with a schedule in which the G and B scan periods have been shifted to a later time, and satisfying a condition, (R wait period)>(G wait period)>(B wait period), is satisfied.

According to the first exemplary embodiment, the optical response characteristic that depends on the wavelength has been taken into consideration, and the wait periods are set so that a condition, (R wait period)>(G wait period)>(B wait period), is satisfied, and therefore in the display panel 100, particularly in the R sub-frame period corresponding to R light that has a long wavelength, R light is irradiated onto the display panel 100 while the pixels are in a state closer to the state in which the transmissivity is in accordance with a designated R component tone. For this reason, according to the first exemplary embodiment, it is possible to avoid a situation in which a different brightness from the brightness designated by the video signal Vid is viewed.

Note that although the wait periods are set so that a condition (R wait period)>(G wait period)>(B wait period), is satisfied, in the first exemplary embodiment, the wait periods may be set so that another condition, (R wait period)>(G wait period)=(B wait period) since R light whose wavelength is the longest is thought to be the color of light that has a large influence. Also, the exemplary case in which the optical responsiveness degrades as the wavelength becomes longer, as shown in FIG. 4, is described above. As another example, in the case in which, conversely, the response characteristic improves as the wavelength becomes longer, or in other words, in the case in which the response characteristic degrades as the wavelength becomes shorter, the wait periods may be set so that another condition, (R wait period)<(G wait period)<(B wait period), or (R wait period)=(G wait period) <(B wait period), is satisfied.

2. Second Exemplary Embodiment

In the color sequential driving according to the first exemplary embodiment, the R, G, and B wait periods are set in consideration of the fact that optical responsiveness depends on the wavelength. According to this configuration, it is possible to avoid a situation in which a different brightness from the brightness designated by the video signal Vid is viewed, but there are cases in which it is difficult to increase the brightness of the entire screen since the R, G and B light emission periods cannot be long. In view of this, in a second exemplary embodiment, emphasis is placed on increasing the brightness of the screen.

Figure 7:
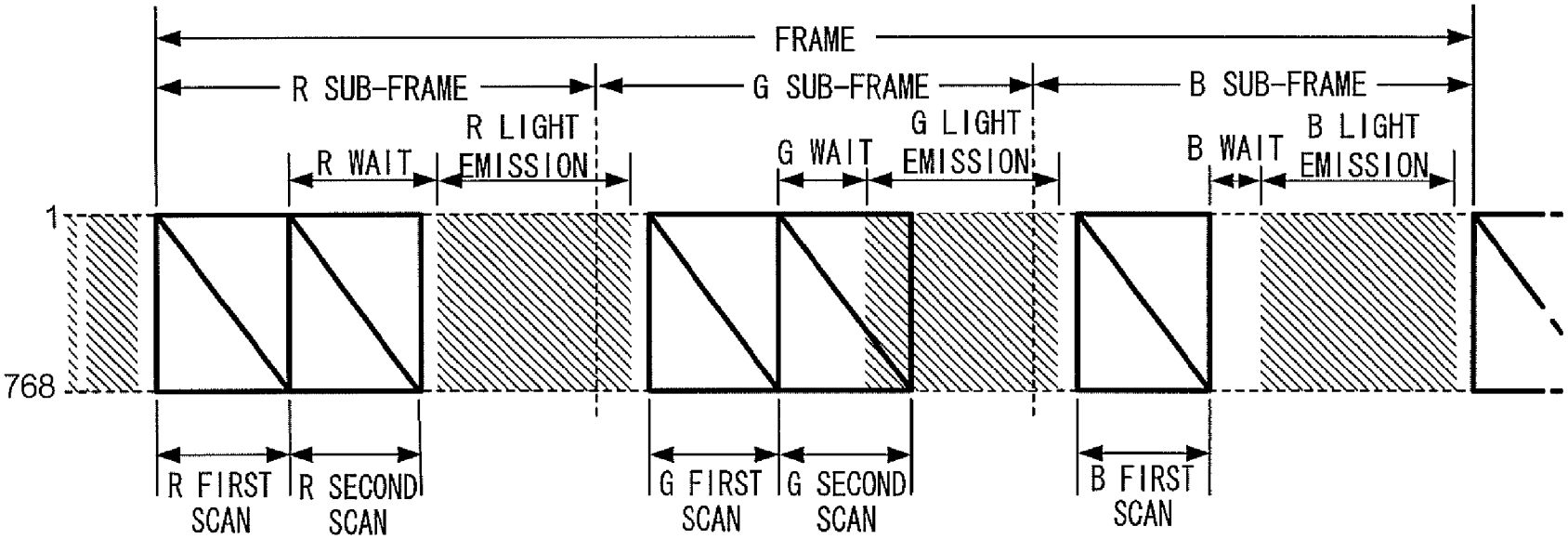
FIG. 7 shows a driving method according to a second exemplary embodiment.

FIG. 7 shows color sequential driving according to the second exemplary embodiment. In the second exemplary embodiment, the writing method in the R scan period (R first scan period) is changed, and furthermore, an R second scan period is added. Likewise, the writing in the G scan period (G first scan period) is changed, and furthermore, a G second scan period is added. However, for the B scan period, the writing in a B first scan period is changed, but a B second scan period is not added. The start timing of the R wait period is the end timing of the R first scan period. Likewise, the start timing of the G wait period is the end timing of the G first scan period. The start timing of the B wait period is the end timing of the B first scan period. In this way, the start timings of the R, G and B wait periods are made earlier. Accordingly, to that extent, the R, G, and B light emission periods can be longer in comparison with the first exemplary embodiment.

Figure 8:
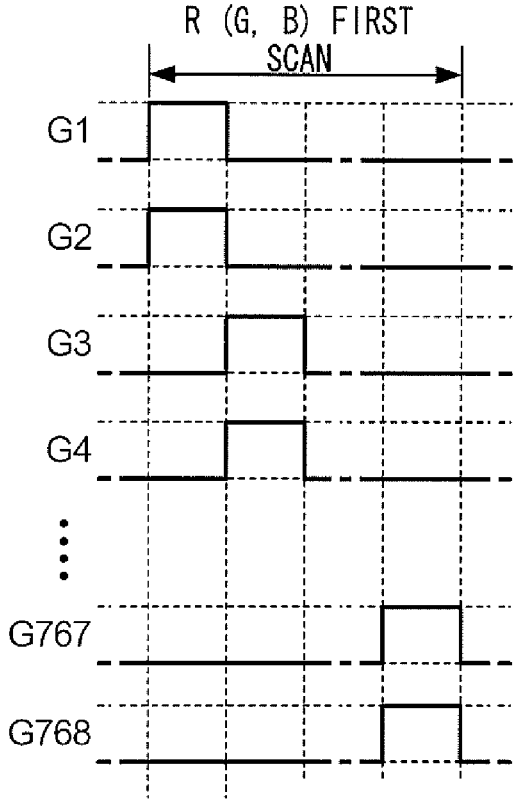
FIG. 8 shows a first scan in the driving method.

First, in the R first scan period, data signals that are in accordance with R component tones are collectively written to the display panel 100 two rows at a time. Specifically, in the R first scan period, the control circuit 20 controls the image processing circuit 30 to read, among the video signals stored in the internal memory, only odd-numbered rows at 3-times speed. Furthermore, the control circuit 20 designates the polarity for the data signal conversion circuit 40. Additionally, the control circuit 20 controls the Y driver 130 to, in order from the top, perform an operation for simultaneously applying the selection voltage to two rows, namely an odd-numbered (1st, 3rd, 5th, . . . , 767th) row and the even-numbered (2nd, 4th, 6th, . . . , 768th) row that is one row down from the odd-numbered row. According to this control, the scan signals G1, G2, G3, . . . , and G768 are output as shown in FIG. 8. Also, the control circuit 20 controls the X driver 140 to sample the data signal Vs and, column-by-column, output the resulting signals to the 1st, 2nd, 3rd, . . . , and 1024th data lines 114 in order.

According to this control, in the R first scan period, when viewing the same column of the display panel 100, a data signal that is in accordance with a tone for a pixel in an odd-numbered row is written simultaneously to two pixels, namely the pixel in the odd-numbered row and a pixel in the even-numbered row that is downwardly adjacent to the odd-numbered row. Accordingly, at the point in time when the R first scan period has ended, although the vertical direction resolution has been reduced by half, voltages that are in accordance with R component tones have been written to the pixels 110. In view of this, the timing when the R first scan period ends is set as the start timing of the R wait period. Note that in the R first scan period, scan lines in two rows are selected simultaneously, and therefore the time required for the R first scan period is half compared to the R scan period in the first exemplary embodiment.

Figure 9:
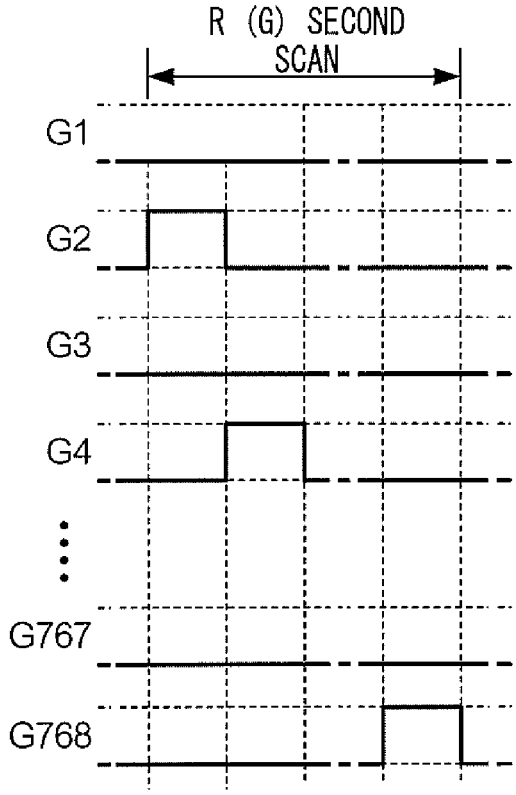
FIG. 9 shows a second scan in the driving method.

Next, in the R second scan period, data signals that are in accordance with R component tones are written to only the pixels 110 of the display panel 100 that are in even-numbered rows. Specifically, in the R second scan period, the control circuit 20 controls the image processing circuit 30 to read, among the video signals stored in the internal memory, only even-numbered rows at 3-times speed. Furthermore, the control circuit 20 designates the polarity for the data signal conversion circuit 40. Additionally, the control circuit 20 controls the Y driver 130 to apply the selection voltage to only the even-numbered (2nd, 4th, 6th, . . . , 768th) scan lines 112 in order. According to this control, the scan signals G1, G2, G3, . . . , and G768 are output as shown in FIG. 9. Also, the control circuit 20 controls the X driver 140 to sample the data signal Vs and, column-by-column, output the resulting signals to the 1st, 2nd, 3rd, . . . , and 1024th data lines 114 in order.

According to this control, in the R second scan period, data signals that are in accordance with tones for pixels in the display panel 100 that are in even-numbered rows are written to these pixels in the even-numbered rows. Although voltages are not written to the pixels in odd-numbered rows in the R second scan period, voltages have already been written in the R first scan period, and therefore in the R second scan period, the pixels in odd-numbered rows hold the voltage that was written in the R first scan period. Accordingly, when the R second scan period has ended, voltages that are in accordance with R component tones for pixels that are to be displayed in the corresponding frame have been written to the pixels 110. The control circuit 20 then waits for the duration of the R wait period once the R first scan period of the R sub-frame period has ended, and thereafter causes only the LED 11R to emit light for the duration of the R light emission period.

In the second exemplary embodiment, the start timing of the R wait period is the time when the R first scan period ends. Accordingly, pixels in even-numbered rows to which voltages are to be written in the R second scan period are irradiated with R light before a transmissivity that is in accordance with a written voltage has been achieved in these pixels. However, a transmissivity that is in accordance with the voltages written in the R first scan period has been achieved in the pixels in odd-numbered rows, and this transmissivity that is in accordance with these written voltages has been achieved in the pixels in even-numbered rows as well until the irradiation with R light ends. For this reason, the resolution of the image that is viewed for the R component is somewhat reduced, but the situation is avoided in which a different brightness from the brightness designated by the video signal Vid is viewed.

Next, in the G sub-frame period, the control circuit 20 controls the display panel 100 in the same way as in the R sub-frame period. Specifically, in the G first scan period, the control circuit 20 performs control so that a data signal that is in accordance with a G component tone for an odd-numbered row is written to two pixels, namely a pixel in the odd-numbered row and a pixel in the downwardly adjacent even-numbered row. Likewise to the R second scan period, in the G second scan period, the control circuit 20 performs control so that data signals that are in accordance with G component tones for even-numbered rows are written to only the pixels in even-numbered rows. The control circuit 20 waits for the duration of the G wait period once the G first scan period has ended, and thereafter causes only the LED 11G to emit light for the duration of the G light emission period.

At this time, it is also possible for the G light emission period to be started during the G second scan period. However, a transmissivity that is in accordance with the voltages written in the G first scan period has been achieved in the pixels in odd-numbered rows, and this transmissivity that is in accordance with these written voltages has been achieved in the pixels in even-numbered rows as well until the irradiation with G light ends. For this reason, the resolution of the G component image is reduced, but the situation is avoided in which a different brightness from the brightness designated by the video signal Vid is viewed.

Next, in the B first scan period of the B sub-frame period, the control circuit 20 controls the display panel 100 in the same way as the R and G first scan periods. Specifically, in the B first scan period, the control circuit 20 performs control so that a data signal that is in accordance with a B component tone for an odd-numbered row is written to two pixels, namely a pixel in the odd-numbered row and a pixel in the downwardly adjacent even-numbered row. However, in the second exemplary embodiment, the B second scan period is not performed. For this reason, in the B sub-frame, at the point in time when the B first scan period has ended, voltages that are in accordance with B component tones for an image whose vertical resolution has been reduced by half have been written to the pixels 110. Then, in order for this B component image to be viewed, the control circuit 20 waits for the duration of the B wait period once the B first scan period has ended, and thereafter causes only the LED 11B to emit light for the duration of the B light emission period. Note that in the second exemplary embodiment, although the resolution is halved for only the B component, a person's ability to decompose resolution is lower with the B component than with the R and G components in the first place, and therefore there is little degradation in the resolution that is actually viewed.

In the second exemplary embodiment, the start timings of the R, G, and B wait periods are set to the end timings of the R, G, and B first scan periods that have been shortened to half the duration of the R, G and B scan periods in the first exemplary embodiment. Accordingly, to that extent, the R, G, and B light emission periods can be longer. For this reason, the screen display can be brighter than in the first exemplary embodiment. Also, an improvement in color reproducibility can be expected since there is little reduction in the resolution that is actually viewed for R, G, and B.

Note that in the second exemplary embodiment, in the R and G first scan periods, an odd-numbered row and an even-numbered row are selected simultaneously, and a voltage that is in accordance with a tone for a pixel in the odd-numbered row is written to two pixels that are vertically adjacent, and in the R and G second scan periods, only an even-numbered row is selected, and a voltage that is in accordance with a tone for a pixel in the even-numbered row is written. However, a configuration is also possible in which, in order to prevent this relationship from become fixed, alternating switching is performed so that in the next frame period, in the R and G first scan periods, an odd-numbered row and an even-numbered row are selected simultaneously, and a voltage that is in accordance with a tone for a pixel in the even-numbered row is written to two pixels that are vertically adjacent, and in the R and G second scan periods, only an odd-numbered row is selected, and a voltage that is in accordance with a tone for a pixel in the odd-numbered row is written. Likewise, a configuration is possible in which, in the B first scan period, if an odd-numbered row and an even-numbered row are selected simultaneously, and the same voltage that is in accordance with a tone for a pixel in the odd-numbered row is written to two pixels that are vertically adjacent, then in the B first scan period of the next frame period, an odd-numbered row and an even-numbered row are selected simultaneously, and a voltage that is in accordance with a tone for a pixel in the even-numbered row is written to two pixels that are vertically adjacent.

Also, in order to provide time for a transmissivity that is in accordance with a written voltage to be achieved, a configuration is possible in which, in addition to B, the R second scan period is also omitted, and the R, G, and B sub-frame periods are set again. Furthermore, although visibility deteriorates since the B sub-frame period lacks the B second scan period, the reduction in resolution cannot be avoided when compared to the R and G components. In view of this, in order to avoid this reduction in resolution, a configuration is possible in which for each frame period, the color that lacks a second scan period is switched in the order of, for example, B, R, G, and next B.

3. Third Exemplary Embodiment

The color sequential driving according to the second exemplary embodiment is effective in terms of ensuring screen brightness, but for the G component whose visibility is the highest, the G light emission period starts during the G second vertical scan, and therefore there is room for improvement in terms of the resolution that is actually viewed. In a third exemplary embodiment, emphasis is placed on an improvement in resolution.

Figure 10:
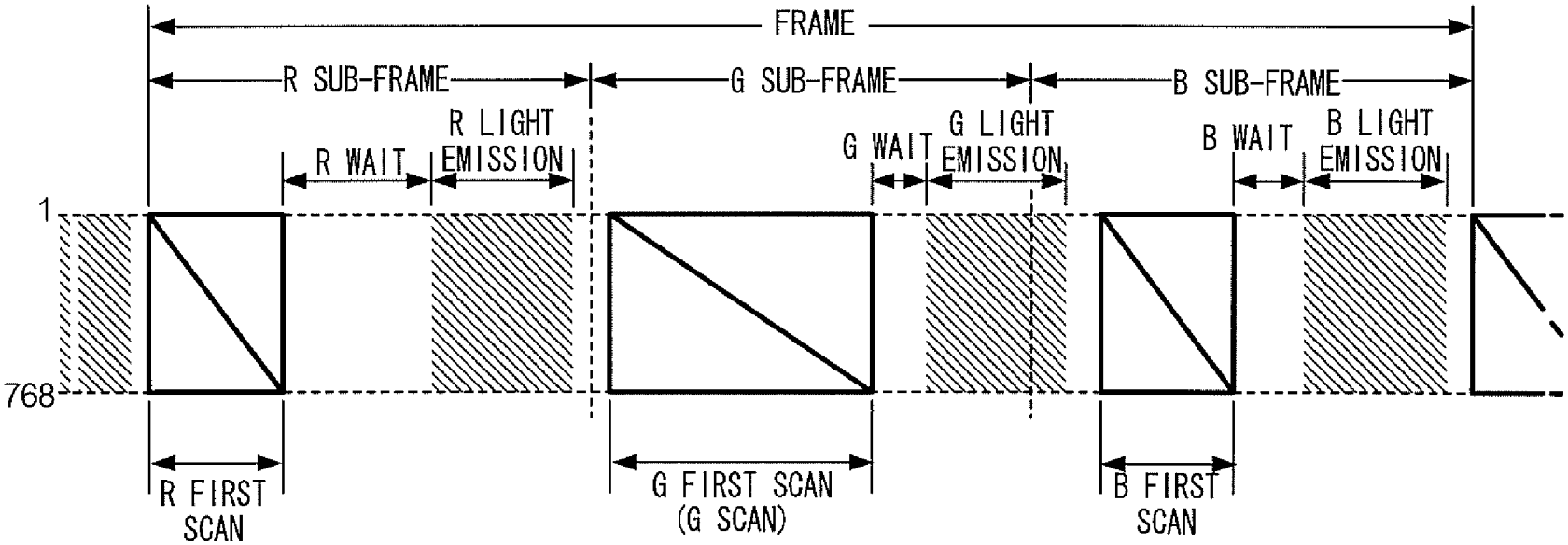
FIG. 10 shows a driving method according to a third exemplary embodiment.

FIG. 10 shows color sequential driving according to the third exemplary embodiment. In the third exemplary embodiment, the R second scan period of the second exemplary embodiment is omitted, and furthermore, the G sub-frame period includes a G scan period that does not cause a reduction in resolution similarly to the first exemplary embodiment. Specifically, two scan lines are simultaneously selected in the R and B first scan periods, but the scan lines are selected one-by-one in the G scan period. Also, in the third exemplary embodiment, the end timing of the G scan period is the start timing of the G wait period. In order to ensure a G light emission period that is longer than in the first exemplary embodiment, the end timing of the R light emission period is somewhat shifted to an earlier time, and the start of the G scan period is made earlier. Note that although the start of the B first scan period is, to this extent, shifted to a later time, there is almost no influence since there is no problem if the B wait period is short.

In this way, in the third exemplary embodiment, although the resolution of the R and B components is reduced since the R second scan period and the B second scan period are omitted in order to ensure the R, G, and B wait periods, there is no reduction in the resolution of the G component whose visibility is the highest, thereby enabling improving the resolution over the second exemplary embodiment.

4. Fourth Exemplary Embodiment

In a fourth exemplary embodiment, technology for ensuring a brighter screen than in the first exemplary embodiment while achieving an equivalent resolution is described.

Figure 11:
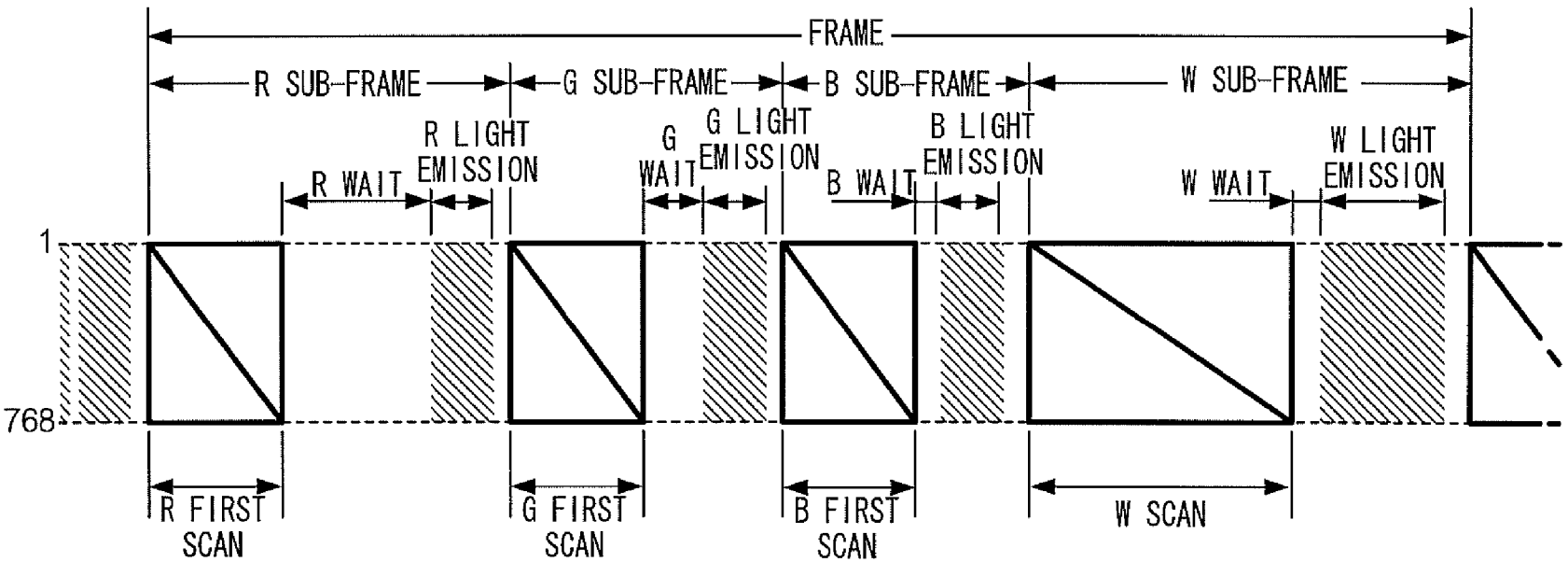
FIG. 11 shows a driving method according to a fourth exemplary embodiment.

FIG. 11 shows color sequential driving according to the fourth exemplary embodiment. As shown in FIG. 11, in the fourth exemplary embodiment, each frame period includes a W sub-frame period in addition to the R, G, and B sub-frame periods. Among these periods, in the R, G, and B sub-frame periods, the durations of the R, G and B first scan periods are the same, and since it is necessary for the durations of the R, G, and B light emission periods to be the same as well, the frame periods are set so that a condition, (R sub-frame period) >(G sub-frame period)>(B sub-frame period), is satisfied in order to satisfy the condition that (R wait period)>(G wait period)>(B wait period).

Likewise to the R, G and B first scan periods in the second exemplary embodiment, in the R, G, and B sub-frame periods, the display panel 100 forms images whose vertical direction resolution has been halved, and light emission by the LEDs 11R, 11G and 11B is executed sequentially.

The W sub-frame period includes a W scan period, a W wait period, and a W light emission period. In the present exemplary embodiment, the W light emission period is set so that a condition, (W light emission period)>(R light emission)=(G light emission period)=(B light emission period), is satisfied.

In the W scan period, the control circuit 20 controls the image processing circuit 30 to read video signals stored in the internal memory, that is to say, video signals that designate the brightness for R, B, and B for each pixel. Furthermore, the control circuit 20 controls the image processing circuit 30 to convert the read video signals into luminance signals indicating a luminance component for each pixel. Also, likewise to the R, G, and B scan periods in the first exemplary embodiment, the control circuit 20 performs the operations described below. Specifically, the control circuit 20 designates the polarity for the data signal conversion circuit 40. Furthermore, the control circuit 20 controls the Y driver 130 to apply the selection voltage to the 1st, 2nd, 3rd, . . . , and 768th scan lines 112 in order, in accordance with the reading row. According to this control, the scan signals G1, G2, G3, . . . , and G768 are output as shown in FIG. 6. Also, the control circuit 20 controls the X driver 140 to sample the data signal Vs and, column-by-column, output the resulting signals to the 1st, 2nd, 3rd, . . . , and 1024th data lines 114 in order.

Accordingly, transmissivity that is in accordance with the respective luminance components is achieved in the pixels 110. In order for an image having these luminance components to be viewed, the control circuit 20 waits for the duration of the W wait period, and thereafter causes all of the LEDs 11R, 11G and 11B to emit light for the duration of the W light emission period. Note that in the W light emission period, all of the LEDs 11R, 11G and 11B may be caused to emit light, or a configuration is possible in which a separate white LED is provided, and the white LED is caused to emit light by itself or along with the LEDs 11R, 11G and 11B.

In this way, in the fourth exemplary embodiment, the resolution of the image viewed for the primary color components is reduced by half in the R, G and B sub-frame periods, but in the W sub-frame period, there is no change in the resolution of the image that is viewed for the luminance component, and furthermore, the W light emission period has been made long. For this reason, in the fourth exemplary embodiment it is possible to ensure a brighter screen than in the first exemplary embodiment, or even in the second and third exemplary embodiments, and furthermore, a resolution equivalent to the first exemplary embodiment is achieved.

5. Concluding Remarks

FIG. 12 shows results of evaluating the exemplary embodiments. FIG. 12 shows the results of a comparison between images displayed by the color sequential driving according to the first to fourth exemplary embodiments. In FIG. 12, the evaluation items that are compared are screen brightness, color reproducibility, and resolution. Note that in FIG. 12, the superiority of the first to fourth exemplary embodiments is indicated by a circle (O), a triangle (Δ), or an X, the circle indicting highest superiority, the X indicating lowest superiority, and the triangle indicating middle superiority. As shown in FIG. 12, the first exemplary embodiment is less superior than the other exemplary embodiments in terms of screen brightness as described above, but the resolution is not reduced by half, and therefore the first exemplary embodiment is more superior than the other exemplary embodiments in terms of resolution. Compared to the first exemplary embodiment, the second exemplary embodiment is somewhat less superior in terms of resolution, but the light emission period can be long, and therefore the second exemplary embodiment is beneficial in terms of screen brightness and color reproducibility. Compared to the second exemplary embodiment, the third exemplary embodiment achieves approximately the same screen brightness and is somewhat beneficial in terms of resolution, but is somewhat unbeneficial in terms of color reproducibility. The fourth exemplary embodiment is beneficial in terms of screen brightness and achieves approximately the same resolution as the second exemplary embodiment, but the fourth exemplary embodiment includes the W light emission period and therefore is unbeneficial in terms of color reproducibility when compared with the second exemplary embodiment.

In this way, the best color sequential driving among the color sequential driving according to the first to fourth exemplary embodiments differs depending on which evaluation item is emphasized. In other words, by employing a configuration in which one of the color sequential driving according the first to fourth exemplary embodiments is selected in accordance with the image to be displayed, it is possible to appropriately perform image display in accordance with the image that is specified by the video signal Vid or the user's preference.

Figure 13:
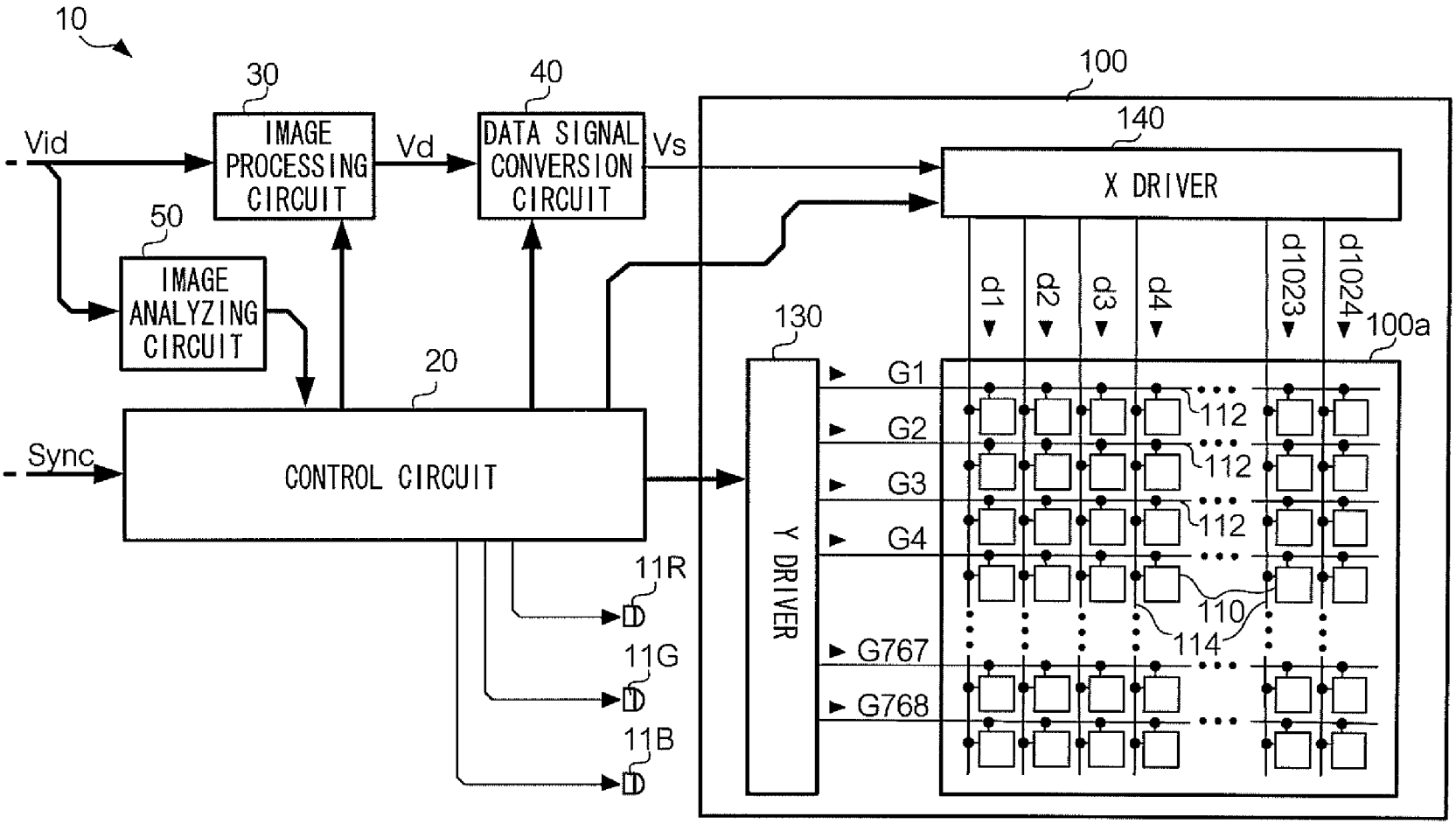
FIG. 13 shows a configuration of a projector to which an exemplary variation of the invention has been applied.

For example, a configuration is possible in which, as shown in FIG. 13, an image analyzing circuit 50 that receives an input of the video signal Vid and analyzes the quality of an image to be display is provided, and the control circuit 20 applies the color sequential driving according to one of the first to fourth exemplary embodiments in accordance with the analysis result. For example, if the result of the analysis of the video signal Vid is that the image is for an office automation application such as a PC, the first exemplary embodiment may be employed due to the need to emphasize resolution. If the video signal Vid relates to a video or the like, the second or third exemplary embodiment may be employed since greater emphasis is placed on color reproducibility than resolution. If the result of a histogram analysis is that there is a high concentration of bright pixels, the fourth exemplary embodiment may be employed due to the need to ensure screen brightness. Providing the image analyzing circuit 50 in this way enables automatically employing an appropriate color sequential driving method in accordance with an image specified by the video signal Vid.

Figure 14:
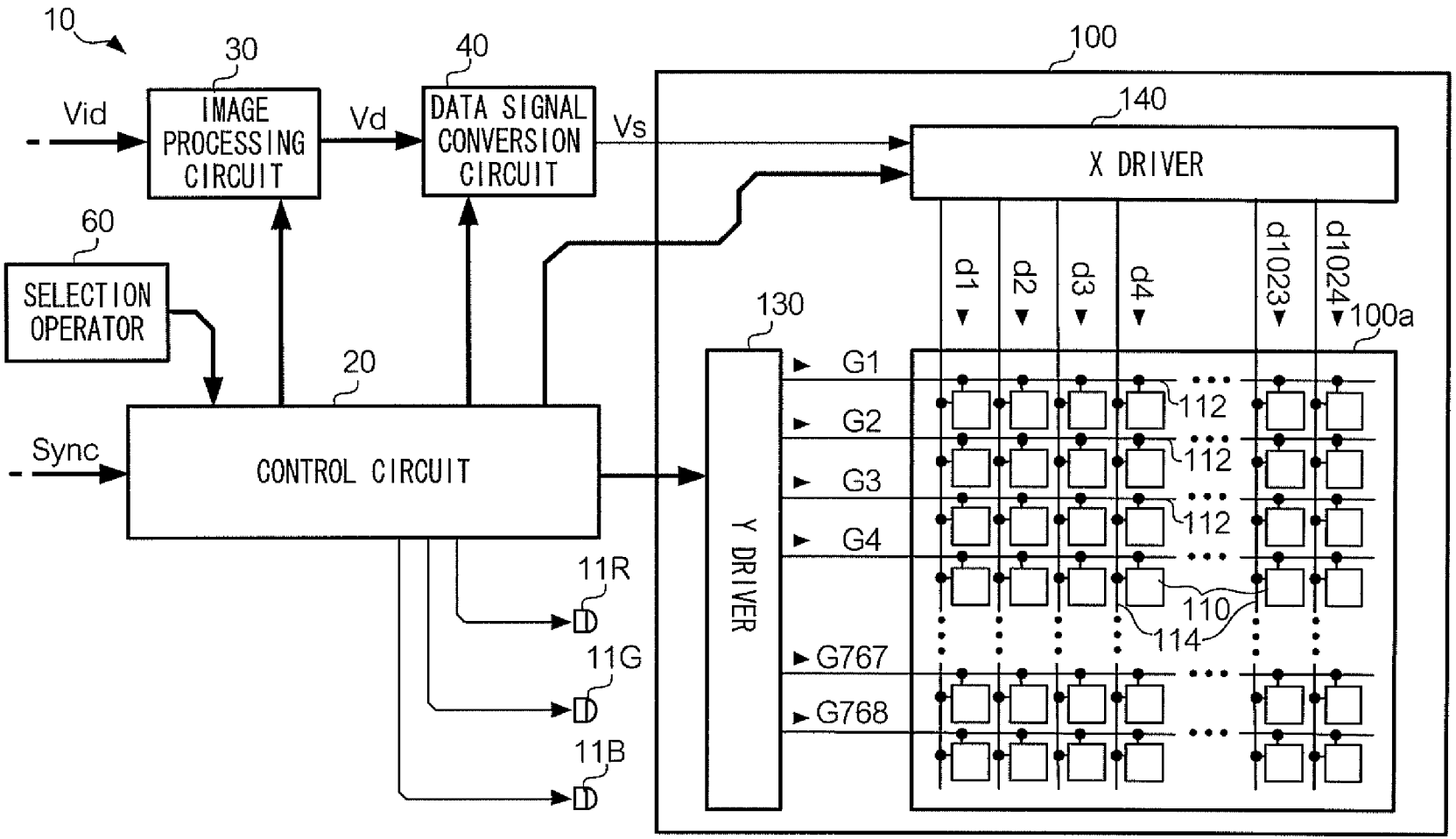
FIG. 14 shows a configuration of a projector to which another exemplary variation of the invention has been applied.

Also, a configuration is possible in which, as shown in FIG. 14, a selection operator 60 such as a button switch or a selector is provided, and in accordance with a selection result therefrom, the control circuit 20 applies one of the color sequential driving according to the first to fourth exemplary embodiments. Providing the selection operator 60 in this way enables employing a color sequential method that reflects the user's preference.

Note that in the first to third exemplary embodiments described above, each frame period is divided into three sub-frame periods corresponding to the three primary colors R, G, and B that are used. However, a configuration is possible in which four or more primary colors are used, and each frame period is divided into four or more sub-frame periods corresponding to these primary colors. For example, a configuration is possible in which among R, G and B, G is divided into YG (yellow-green) on the short wavelength side and EG (emerald-green) on the long wavelength side, and each frame period is divided into four sub-frame periods corresponding to these four colors. If four or more primary colors are used, it is necessary to provide two or more dichroic prisms. In the case of using R, YG, EG and B as described above, it is sufficient to have a configuration in which another dichroic prism is disposed in the 9 o'clock direction with respect to the dichroic prism 13 in FIG. 1, and two faces of the other dichroic prism guide incident YG and EG light to the dichroic prism 13. Furthermore, the invention can be applied to not only a projection apparatus that enlarges and projects a transmission image formed by the display panel 100, but also a direct-view apparatus in which the backlight light source is switched for each primary color. Also, the pixels 110 are not limited to being transmissive, but instead may be reflective.

What is claimed is:

1. A driving method for an electro-optical apparatus that includes a plurality of pixels and an irradiation unit, each of the pixels having a transmissivity or a reflectivity in response to writing, the irradiation unit sequentially irradiating the plurality of pixels with at least three different primary colors of light, the method comprising:

dividing a unit period into a plurality of sub-frame periods corresponding to the primary colors;

writing a primary color component in each sub-frame period by a first scan executed on the plurality of pixels;

irradiating, in each sub-frame period, the plurality of pixels with the corresponding primary color of light by the irradiation unit at a timing that is after the first scan and before the first scan of a subsequent sub-frame period; and waiting for duration of a wait period that is from when the first scan of one primary color component among the at least three colors ends until when the irradiation unit starts irradiating the one primary color of light, the wait period for the one primary color being different from wait periods for the other colors, each of the durations of the plurality of sub-frame periods for the primary colors being different in response to each of the durations of the wait periods for the primary colors, wherein the wait period of each primary color is made longer as a response speed of the primary color is determined to be slower with respect to the other primary colors due to different response speeds of wavelengths of light of each primary color, or is made shorter as the response speed of the primary color becomes faster.

2. The driving method according to claim 1, wherein the wait period of each primary color is made longer as the wavelength of the primary color is shorter, or shorter as the wavelength of the primary color is shorter.

3. The driving method according to claim 1, wherein in the first scan, writing is executed on the plurality of pixels such that an image whose resolution is lower than a resolution specified for the plurality of pixels is formed, and execution or non-execution of a second scan is defined for each primary color, the second scan being a scan in which writing is executed on the plurality of pixels such that an image whose resolution is higher than the low resolution is formed, subsequent to the first scan.

4. The driving method according to claim 3, wherein a primary color for which non-execution of the second scan is defined is, among the primary colors, a color whose optical response to writing is the fastest.

5. The driving method according to claim 3, wherein a primary color for which non-execution of the second scan is defined is changed for each unit period.

6. The driving method according to claim 1, wherein the resolution of an image formed by the first scan of one primary color component among the at least three colors is caused to be different from the resolution of images formed by the first scan of the other color components.

7. The driving method for the electro-optical apparatus according to claim 6, wherein the primary color for which the resolution of the image formed by the first scan is highest is, among the at least three primary colors, a color excluding a primary color whose wavelength is the shortest and a primary color whose wavelength is the longest.

8. The driving method according to claim 6, wherein the primary color for which the resolution of the image formed by the first scan is lowest is, among the at least three primary colors, a color whose optical response to writing is the fastest.

9. The driving method according to claim 1, wherein the irradiation unit is capable of irradiating white light in addition to the at least three different primary colors of light, the unit period is divided into a plurality of sub-frame periods corresponding to the primary colors and white, the irradiation unit irradiates the plurality of pixels with the white light at a timing that is after the first scan of the white component and before the first scan of a subsequent sub-frame period, and the resolution of an image formed by the first scan of the white component is caused to be higher than the resolution of images formed by the first scan of the primary color components.

10. A driving method for an electro-optical apparatus that includes a plurality of pixels each having a transmissivity or a reflectivity that is in response to writing, and an irradiation unit that sequentially irradiates the plurality of pixels with at least three different primary colors of light, the method comprising:

dividing a unit period into a plurality of sub-frame periods corresponding to the primary colors;

writing a primary color component in each sub-frame period by a first scan executed on the plurality of pixels;

irradiating, in each sub-frame period, the plurality of pixels with the corresponding primary color of light by the irradiation unit at a timing that is after the first scan and before the first scan of a subsequent sub-frame period;

waiting for a duration of a wait period that is from when the first scan of one primary color component among the at least three colors ends until when the irradiation unit starts irradiating the one primary color of light, the wait period for the one primary color being different from the wait periods for the other colors, each of the durations of the plurality of sub-frame periods for the primary colors being different in response to each of the durations of the wait periods for the primary colors; and selecting one process from among the following process A to D:

(A) a process in which the wait period of each primary color is made longer as the wavelength of the primary color is shorter, or shorter as the wavelength of the primary color is shorter;

(B) a process in which in the first scan, writing is executed on the plurality of pixels such that an image whose resolution is lower than a resolution specified for the plurality of pixels is formed, execution or non-execution of a second scan is defined for each primary color, the second scan being a scan in which writing is executed on the plurality of pixels such that an image whose resolution is higher than the low resolution is formed, subsequent to the first scan, and a primary color for which non-execution of the second scan is defined is, among the primary colors, a color whose optical response to writing is the fastest;

(C) a process in which the resolution of an image formed by the first scan of one primary color component among the at least three colors is caused to be different from the resolution of images formed by the first scan of the other color components, and a primary color for which the resolution of the image formed by the first scan is the highest is, among the at least three primary colors, a color excluding a primary color whose wavelength is the shortest and a primary color whose wavelength is the longest; and (D) a process in which the irradiation unit is capable of irradiating white light in addition to the at least three different primary colors of light, the unit period is divided into a plurality of sub-frame periods corresponding to the primary colors and white, the irradiation unit irradiates the plurality of pixels with the white light at a timing that is after the first scan of the white component and before the first scan of a subsequent sub-frame period, and the resolution of an image formed by the first scan of the white component is caused to be higher than the resolution of images formed by the first scan of the primary color components, wherein the wait period of each primary color is made longer as a response speed of the primary color is determined to be slower with respect to the other primary colors due to different response speeds of wavelengths of light of each primary colors, or is made shorter as the response speed of the primary color becomes faster.

11. An electro-optical apparatus comprising:

a plurality of pixels each having a transmissivity or a reflectivity that is in accordance with writing;

an irradiation unit that sequentially irradiates the plurality of pixels with at least three different primary colors of light;

a driving circuit that divides a unit period into a plurality of sub-frame periods corresponding to the primary colors, and writes a primary color component in each sub-frame period by a first scan executed on the plurality of pixels; and a control circuit that controls the irradiation unit to, in each sub-frame period, irradiate the plurality of pixels with the corresponding primary color of light at a timing that is after the first scan and before the first scan of a subsequent sub-frame period, and performs control so that a wait period that is from when the first scan of one primary color component among the at least three colors ends until when the irradiation unit starts irradiating the one primary color of light is different from wait periods for the other colors, each of the durations of the plurality of sub-frame periods for the primary colors being different in response to each of the durations of the wait periods for the primary colors, wherein the wait period of each primary color is made longer as a response speed of the primary color is determined to be slower with respect to the other primary colors due to different response speeds of wavelengths of light of each primary color, or is made shorter as the response speed of the primary color becomes faster.

* * * * *

UNITED STATES PATENT AND TRADEMARK OFFICE

CERTIFICATE OF CORRECTION

PATENT NO. : 8,638,289 B2
APPLICATION NO. : 12/606790
DATED : January 28, 2014
INVENTOR(S) : Iisaka et al.

It is certified that error appears in the above-identified patent and that said Letters Patent is hereby corrected as shown below:

Title Page, Item (54), and in the Specification, Column 1, Line 4, delete "ANS" and insert -- AND --, therefor.

Signed and Sealed this
Twenty-first Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,638,289 B2
APPLICATION NO. : 12/606790
DATED : January 28, 2014
INVENTOR(S) : Iisaka et al.

It is certified that error appears in the above-identified patent and that said Letters Patent is hereby corrected as shown below:

On the title page, item (73), under "Assignee", delete "Seiko Epson Corporation (Tokyo, JP)" and insert -- Seiko Epson Corporation (Tokyo, JP); NEC Display Solutions, Ltd. (Tokyo, JP) --, therefor.

Signed and Sealed this
Seventeenth Day of March, 2015

Michelle K. Lee

Michelle K. Lee
*Director of the United States Patent and Trademark Office*